US005119745A

United States Patent [19]

Terry

[11] Patent Number: 5,119,745

[45] Date of Patent: Jun. 9, 1992

[54] SEWING MACHINE ACCESSORY FOR CIRCULAR SEWING

[76] Inventor: Lynne Terry, 32031 Via Canela, San Juan Capistrano, Calif. 92675

[21] Appl. No.: 691,076

[22] Filed: Apr. 25, 1991

[51] Int. Cl.[5] ..... D05B 3/00

[52] U.S. Cl. ..... 112/121.24; 112/260

[58] Field of Search ..... 112/121.12, 121.15, 112/121.24, 308, 309, 260; 33/27.01, 27.03

[56] References Cited

U.S. PATENT DOCUMENTS

| | | | |
|---|---|---|---|
| 716,117 | 12/1902 | Scott | 112/121.24 |
| 880,829 | 3/1908 | Scott | 112/121.24 X |
| 1,682,362 | 8/1928 | Halle | 112/121.24 X |
| 2,717,566 | 9/1955 | Szczepanski et al. | 112/121.24 |
| 3,082,721 | 3/1963 | Bono | 112/102 |
| 3,374,753 | 3/1968 | Rakacs | 112/257 X |
| 3,410,237 | 11/1968 | Hanyu | 112/102 |
| 3,561,381 | 2/1971 | Weiss | 112/114 |
| 3,766,870 | 10/1973 | Weigert | 112/104 |
| 4,416,208 | 11/1983 | Nufer | 112/121.11 X |
| 4,424,704 | 6/1985 | Cusamano | 112/105 |
| 4,493,275 | 1/1985 | Fischer | 112/105 |
| 4,554,877 | 11/1985 | Cusumano | 112/105 |

FOREIGN PATENT DOCUMENTS 1299433 6/1962 France .

OTHER PUBLICATIONS

Elna Corporation Model 9000 Sewing Machine 3 pages.

*Primary Examiner*—Werner H. Schroeder
*Assistant Examiner*—Paul C. Lewis
*Attorney, Agent, or Firm*—Roy A. Ekstrand

[57] ABSTRACT

A sewing machine accessory for circular sewing includes an elongated planar work table defining a planar work surface and a plurality of support legs for supporting the work table in general alignment with the end portion of a conventional sewing machine workbed. The table defines an elongated slot running the length of the work surface and a plurality of material tacks which define pointed members for piercing a to-be-supported material or fabric. In its intended use, the material or fabric is placed upon the work surface of the accessory and positioned with respect to the path of the stitching needle of the sewing machine. Thereafter, a pivotal support for the material is formed at the desired center of rotation by piercing the material with the pointed element of a material tack and embedding the material tack pointed element within the work table. The sewing machine is then operated during which time the pivotal attachment of the material tacked to the work table provides a center of rotation for the material. In an alternate embodiment, an extending plate is provided which is secured to the material table and supports an upwardly extending pointed element for positioning the center of rotation closer to the needle path and inside the junction of the sewing machine material bed and the work table.

11 Claims, 3 Drawing Sheets 100
10
11
12
13
14
15
20
21
22
23
24
25
27
28
34
35
36
40
41
50
51
52
53
54
55
61
80
81
82
83
90
91
92

SEWING MACHINE ACCESSORY FOR CIRCULAR SEWING

SPECIFICATION

1. Field of the Invention

This invention relates generally to sewing machine accessories and particularly to those which facilitate the stitching of a circular or arced stitch.

2. Background of the Invention

The sewing machine has been a substantial part of the work and craft aspects of homes and industries for many years. From earliest machines in which foot-powered units provided little more that straight single stitch sewing, sewing machines have developed and grown to provide a worldwide industry and one of the most pervasive machines of modern times. The sewing machines themselves have been developed to include a wide variety of enhancements and improvements with today's modern electrically powered and often microprocessor controlled machines having a complexity which parallels other sophisticated electro-mechanical products.

While sewing machines themselves have become multi-featured and extremely sophisticated, the machines have added little to aid in the handling and manipulation of the fabric being sewn. As a result, the skills of the tailor or seamstress are often absorbed with the proper manipulation and feeding of the material through the stitching portion of the sewing machine. The process remains basically one of manual manipulation of the material or fabric and the precision and quality of the stitch placement on the flexible and often stretchable fabric or material remains largely a function of the operator's skill.

Perhaps one of the more difficult tasks associated with the operation of a sewing machine is found in attempts to stitch or sew circular or arced patterns upon the material. It is often difficult to consistently maintain the proper radius of curvature upon the fabric as the material or fabric is fed through the stitching mechanism of the machine. The inaccuracies of this process are particularly evident in attempts to close circular stitches. In essence, inaccuracies of circular stitching are clearly evident when the circle is completed and the seams simply don't meet properly. While complex mechanisms are available in commercial and industrial sewing operations, a need remains for a convenient and easy to manipulate mechanism for use in connection with more conventional personal or home machines.

In attempts to meet this need, practitioners in the art have provided a variety of attachments and accessories for sewing machines.

For example, U.S. Pat. No. 3,374,753 issued to Rakas sets forth a CIRCULAR STITCHING ATTACHMENT FOR SEWING MACHINES in which a generally rectangular support plate is secured to the material bed portion of an otherwise conventional sewing machine near the machine needle and throatplate. The support plate includes a bracket which supports an elongated linear rigid member having a generally L-shaped end and supporting an upwardly extending pointed pivot member. A protecting point cover is receivable upon the point member. The position of the elongated member is adjusted within the bracket to position the upwardly extending pointed member at the desired distance from the path of the machine's needle. The material is placed upon and pierced by the pointed member and captivated thereon by the point cover.

Thereafter, the pointed member provides a center of radius for the material at the point of piercing.

U.S. Pat. No. 3,410,237 issued to Hanyu sets forth a SEWING MACHINE ATTACHMENT FOR CIRCULAR STITCHING in which a circular bracket having a generally planar annular configuration is rotatably supported upon a sewing machine bed in an offset relationship with the path of the machine's needle. The plate is rotatable to support the material during the stitching operation.

U.S. Pat. No. 3,082,721 issued to Bono sets forth a WORK HOLDING DEVICE FOR USE WITH SEWING MACHINES in which a work holding device is provided with indexing means to facilitate the positioning of the to-be-sewn cloth at a desired angle without the machine operator having to mark the cloth on the desired pattern.

In addition, the machine manufactured and sold by Elna Corporation and identified as Model 9000 provides a pivotally supported table which may be secured to the material bed portion of the sewing machine to provide a pivotal support for rotating material upon the machine bed and thereby facilitate circular sewing. In addition, a second device is provided which comprises an elongated rigid member similar to that set forth above in U.S. Pat. No. 3,374,753. In the Elna device, the elongated rigid member is received within the throatplate aperture of the machine bed and is adjustable in length to provide a variable distance between the stitching needle path of the machine in an upwardly extending pointed pivot.

Other attachments have been provided for sewing machines. For example, U.S. Pat. No. 4,416,208 sets forth an AUXILIARY DEVICE FOR A SEWING MACHINE which comprises tappets and switches in the coupling portions of the presser foot shaft. The tappets are arranged in accordance with a predetermined code and activate a combination of switches which control an electronic circuit to provide the desired sewing operation.

U.S. Pat. No. 3,766,870 issued to Weigert sets forth a SEWING MACHINE ATTACHMENT which cuts a label from a label ribbon, folds the label and feeds the folded label into the machine for automatic attachment to the garment.

U.S. Pat. No. 4,554,877 issued to Cusumano, et al. sets forth an ALIGNMENT SYSTEM FOR A GARMENT ACCESSORY-HOLDING JIG which includes an attachment plate attachable to the host sewing machine in a predetermined relationship with respect to the needle. A sliding bar is held in slideable relationship with the attachment plate. Means are provided for attaching a guide template to the holding device to provide proper alignment of the needle of the sewing machine.

U.S. Pat. No. 4,524,704 issued to Cusumano sets forth an ACCESSORY-HOLDING JIG PROVIDING MULTIPLE SEWING POSITIONS which is used for holding an accessory relative to the needle of a sewing machine. A first captive sliding bar and accessory holder attached to the bar are supported upon the sewing machine. Stop locations such as detents are provided on the sliding bar to provide detentable positions of the accessory.

U.S. Pat. No. 4,493,275 issued to Fischer sets forth a SEWING MACHINE ATTACHMENT for use in facilitating the stitching of a finding such as a hook or eye with two or three spaced apart locations to an underlying fabric. The attachment includes a base on which a cross slide assembly is mounted for supporting a retaining device movable in two mutually orthogonal directions. A handle and guide member are displaceable along a part circular track and a retaining device is adapted to hold the finding in different desired positions.

U.S. Pat. No. 3,561,381 issued to Weiss sets forth a SEWING MACHINE BUTTON HOLDING MECHANISM for button sewing machines. The device includes a turrethead structure including a selectively positionable turret wheel having a circular plurality of button seats for stationarily seating a variety of styles and sizes of shank buttons.

While the foregoing described prior art devices have in some manner provided for circular sewing, there remains a continuing need in the art for a sewing machine attachment which facilitates circular sewing and which may be used without modification or adaptation of the host sewing machine.

SUMMARY OF THE INVENTION

Accordingly, it is a general object of the present invention to provide an improved sewing machine attachment for circular sewing. It is a more particular object of the present invention to provide an improved sewing machine attachment for circular sewing which requires no modification of the host machine. It is a still more particular object of the present invention to provide an improved sewing machine attachment for circular sewing which easily accommodates large portions of to-be-sewn fabric and facilitates sewing of large radius stitches.

In accordance with the present invention, there is provided for use in combination with a sewing machine having a workbed surface for supporting material during the sewing process, an accessory for sewing arc shaped stitch paths comprises: a generally planar table defining an interior passage and having a work surface defining an elongated slot therein; support means for supporting the table with the work surface in general alignment with the workbed surface; a material tack having a head portion and a pointed member; and a support plate formed of a pierceable material and received and supported within the elongated slot having a characteristic for permitting the pointed member to be held by the pierceable material when it pierces the support plate, the table being aligned with the workbed of the sewing machine and receiving to-be-stitched material and rotatably attached to the table by the material tack piercing the material.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

Description of the Preferred Embodiments

Figure 1:
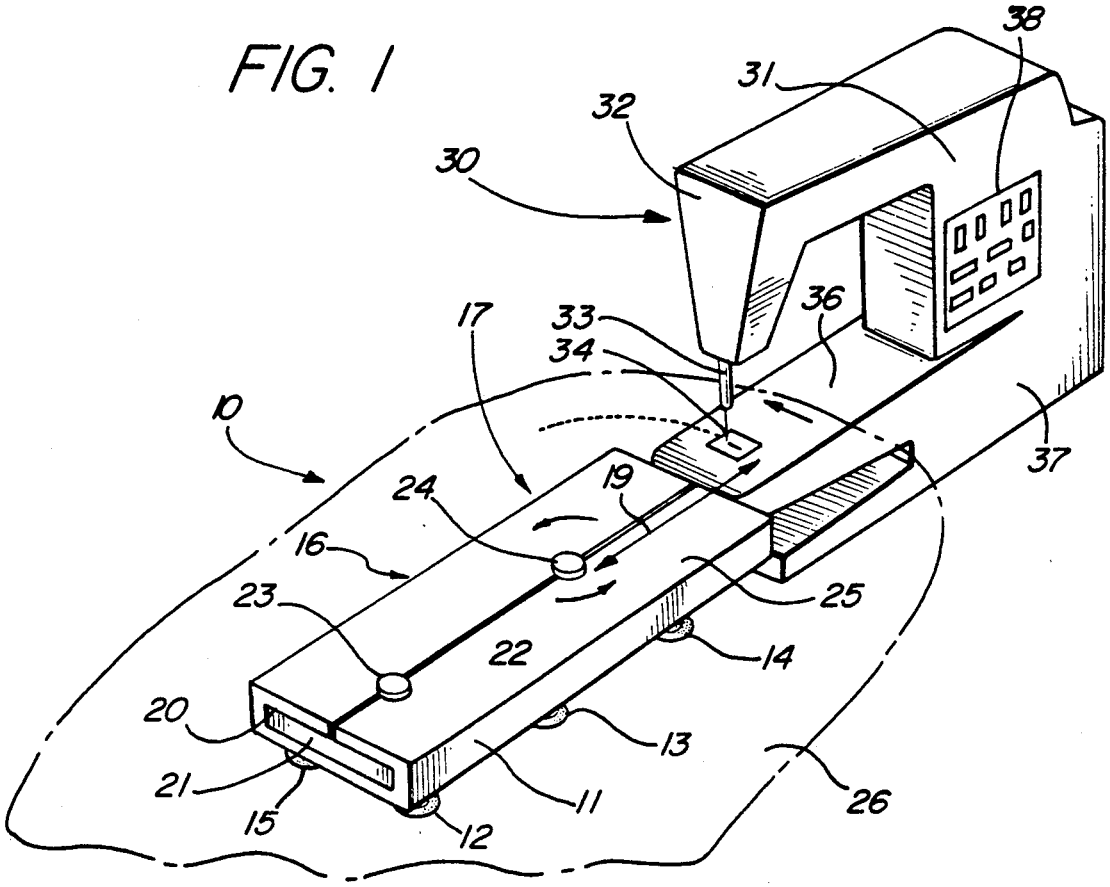
FIG. 1 sets forth a perspective view of a typical sewing machine and a circular sewing accessory constructed in accordance with the present invention.

FIG. 1 sets forth a perspective view of a sewing machine accessory constructed in accordance with the present invention and generally referenced by numeral 10. Accessory 10 includes a material table 11 formed in a generally rectangular configuration and defining a planar work surface 25 on its upper side. Work surface 25 defines an elongated slot 22 extending along the major axis of work surface 25. A plurality of supporting feet 12, 13, 14 and 15 and 16 and 17 (feet 16 and 17 not seen in FIG. 1) are spaced about the bottom surface of material table 11 and provide a rigid attachment therefor. While virtually any structure may be used for feet 12 through 17, it has been found advantageous to utilize downwardly facing suction cup attachments to provide secure placement of accessory 10 in the operation thereof described below. Material table 11 further defines an internal generally rectangular passage 20 which extends the length of and entirely through material table 11. A rectangular planar support plate 21 formed of fibrous material or other material capable of being readily pierced is received within passage 20 and supported beneath slot 22. A pair of material tacks 23 and 24 define downwardly extending pointed members 40 and 41 (seen in FIG. 2) which are received within slot 22 and which, in the installed position shown in FIG. 1, pierce support plate 21 in a piercing engagement.

A sewing machine 30, constructed in accordance with conventional fabrication techniques, includes a body 31 supporting a sewing head 32 and a material arm 36 upon a base 37. Sewing head 32, in accordance with conventional fabrication techniques, supports a downwardly extending needle shuttle 23 which in turn supports a stitching needle 34. A throatplate 35 is supported upon material arm 36 in alignment with needle shuttle 33 in further accordance with conventional fabrication techniques. Sewing machine 30 may be fabricated in virtually any manner in which sewing machines are constructed and in accordance with conventional fabrication techinques is operative to move needle shuttle 33 and needle 34 in a reciprocating motion while cooperating mechanisms (not shown) are operative to provide conventional stitching or sewing action.

In accordance with the present invention, a segment of to be-sewn material 26 which for purposes of illustrations in FIG. 1 is shown in dashed outline and is depicted as generally "see-through" to permit illustration of sewing machine 30 and accessory 10 is placed upon work surface 25 of accessory 10 and material arm 36 of sewing machine 30. Material 26 may comprise any type of fabric capable of being sewn by sewing machine 30 in a conventional sewing process. In further accordance with the present invention and as is set forth below in greater detail, material 26 is positioned upon work surface 25 of accessory 10 to properly align and position material 26 to locate the to-be-sewn seam shown as dashed line arc 18 at the proper place and orientation of material 26. Thereafter, material tack 24 is positioned the appropriate distance from needle 34 of machine 30 along slot 22 of work surface 25 to provide the desired radius of curvature shown by reference numeral 19. Material tack 24 is then forced downwardly piercing material 26 with pointed element 41 and forcing pointed element 41 into slot 22 and ultimately piercing and being embedded within support plate 21. As mentioned, support plate 21 is formed of a fibrous material or similar material which receives the pointed portions of material tacks 23 and 24 in a piercing attachment. For convenience, material tack 23 is also placed within slot 22. However, material tack 23 is placed beneath material 26 and thus does not pierce material 26. Thereafter, with material tack 24 in place, the operation of sewing machine 30 is carried forward to provide the desired stitching action during which time material 26 is pivoted about material tack 24 and slowly rotates thereabout to produce the desired arced or circular stitching. In accordance with an important aspect of the present invention, material tack 24 may be placed virtually anywhere within slot 22 and thus facilitates the creation of any radius of curvature.

Figure 2:
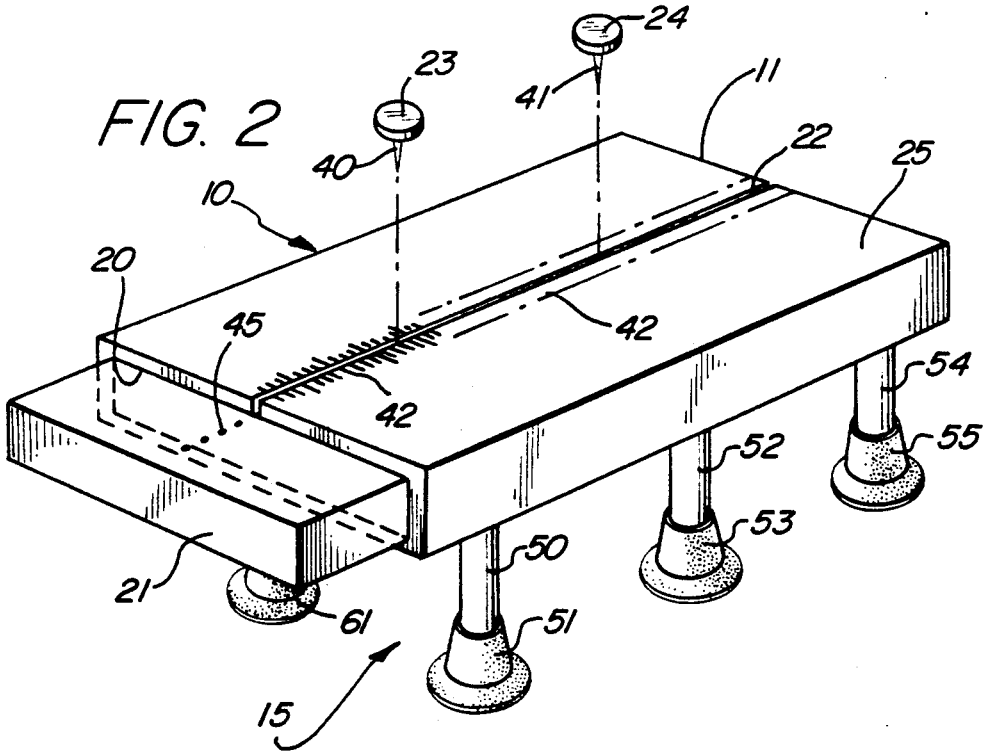
FIG. 2 sets forth a perspective view of a sewing machine accessory for circular sewing constructed in accordance with the present invention.

FIG. 2 sets forth a perspective view of a sewing machine accessory constructed in accordance with the present invention and generally referenced by numeral 10. As described above, sewing accessory 10 includes an elongated generally rectangular work table 11 defining a planar work surface 25 and a center slot 22 extending the length of work surface 25. Table 11 further defines a generally rectangular interior passage 20 extending through work table 11 and receiving a rectangular support plate 21. Support plate 21 is preferably formed of a fibrous material which readily receives a piercing element in a removable fixed attachment. Work surface 25 further defines a plurality of measuring graduations 42 arranged along either side of slot 22. Graduations 42 preferably extend the entire length of work surface 25 and provide a convenient means of measuring distances along work surface 25. A plurality of support legs such as support legs 50, 52 and 54 are secured to the underside of work table 11 and extend generally downwardly therefrom. In the preferred embodiment, support legs 50 through 54 terminate in a downwardly facing suction cup plurality 51, 53 and 55 respectively. Similarly, a second plurality of support legs 60, 62 and 64 (seen in FIG. 4) include a corresponding plurality of downwardly facing suction cup supports 61, 63 and 65 respectively (also seen in FIG. 4). A pair of material tacks 23 and 24 define generally disk-shaped members preferably formed of a molded plastic material or the like defining respective downwardly extending pointed members 40 and 41. In accordance with the above-described operation of the present invention, material tacks 23 and 24 are insertable into slot 22 at the desired place along work surface 25. As a result of this insertion and the piercing of support plate 21 as accessory 10 is used on successive material operations, a plurality of pierced holes such as holes 45 are formed in support plate 21. As pierced holes 45 accumulate, deterioration of support plate 21 occurs and, in accordance with an important aspect of the present invention, support plate 21 may be reversed from the position shown in FIG. 2 and reinserted into passage 20 to provide additional piercing surfaces for pointed elements 40 and 41. Once both sides of support plate 21 have been pierced beyond the desired number of piercings, in further accordance with the present invention support plate 21 may be withdrawn entirely and disposed of and replaced by a replacement support plate (not shown).

Figure 3:
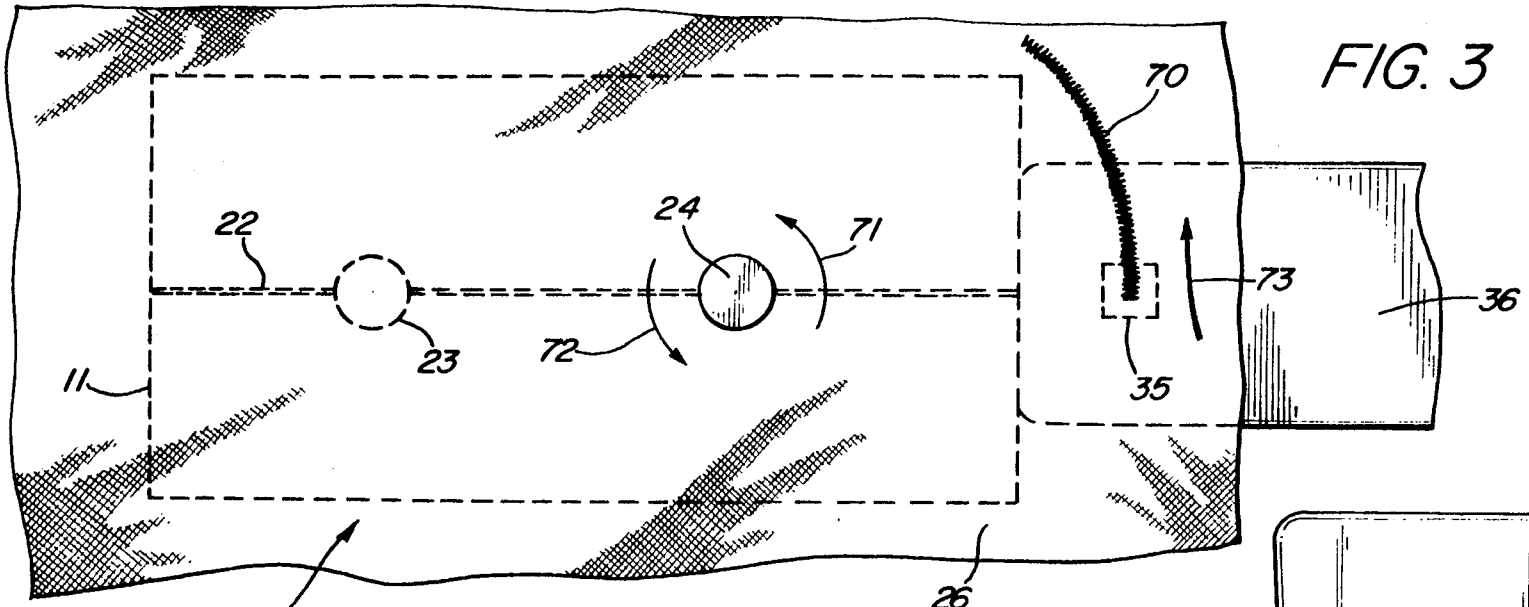
FIG. 3 sets forth a top view of the present invention sewing machine accessory in operation.

FIG. 3 sets forth a top view of a portion of sewing machine 30 and accessory 10 covered by material 26. Thus, sewing machine 30 is constructed as described above in FIG. 1 and includes a material arm 36 supporting a throatplate 35 and receiving a reciprocating needle 34. Material 26 is received upon material arm 36 and material table 11 of sewing machine accessory 10 is positioned in abutment with the end portion of arm 36. As positioned, slot 22 defined in material table 11 extends outwardly from and is generally aligned with the path of reciprocating needle 34. For convenience, material tack 23 is received within slot 22 and is positioned beneath material 26 and thus makes no engagement therewith. Conversely, material tack 24 is positioned above and pointed element 41 (seen in FIG. 2) thereof pierces material 26 at the desired pivoting center for the anticipated sewing operation. Material tack 24 pierces material 26 and passes through slot 22 to be embedded within and received by support plate 21 (seen in FIG. 2). Thus, in the position shown, material 26 is pivotable about material tack 24 in the direction indicated by arrow 71 and arrow 72. The resulting motion of material 26 as sewing machine 30 is operated carries material 26 in the direction indicated by arrow 73. The pivotal attachment of material tack 24 to material 26 causes this motion to be converted to a rotating motion about material tack 24 producing an arced stitching path 70.

Figure 4:
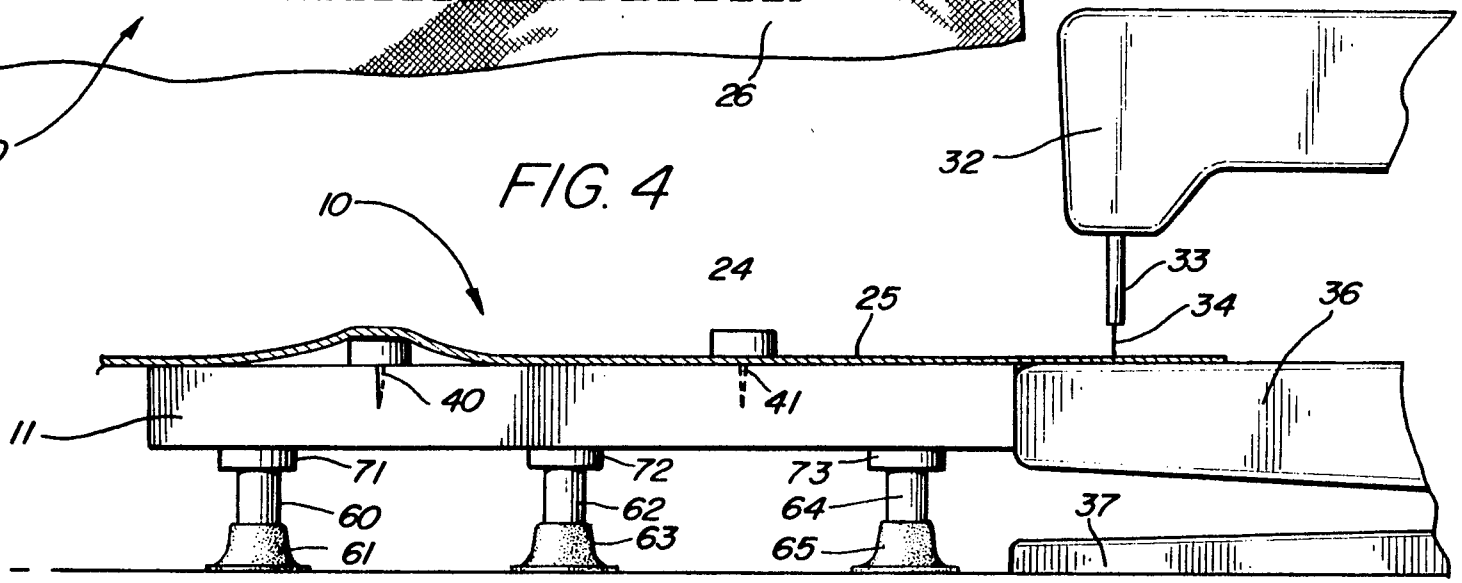
FIG. 4 sets forth a side elevation view of the present invention sewing machine accessory in operation.

FIG. 4 sets forth a side view of the operation of accessory 10 and sewing machine 30 shown above in FIG. 3. Accordingly and as described above, accessory 10 includes a planar rectangularly shaped work table 11 supported by a plurality of downwardly extending legs including legs 60, 62 and 64 having suction cup feet 61, 63 and 65 respectively. While the supporting legs of accessory 10 may be secured to table 11 using virtually any attachment, it has been found advantageous to provide a plurality of threaded receptacles such as receptacles 71, 72 and 73 upon the underside of table 11. It will be apparent to those skilled in the art that legs 50, 52 and 54 (seen in FIG. 2) are similarly supported beneath table 11. Correspondingly, the support legs of accessory 10 define external threads which are threadably received within receptacles 71, 72 and 73 to provide adjustable height thereof and to facilitate the proper attachment of table 11 to the underlying work surface supporting sewing machine 30. As can be seen in FIG. 4, material 26 is received upon work surface 25 and pivotally secured by tack 24 while tack 23 is positioned beneath material 26 and conveniently located upon work surface 25.

Figures 5, 6, 7:
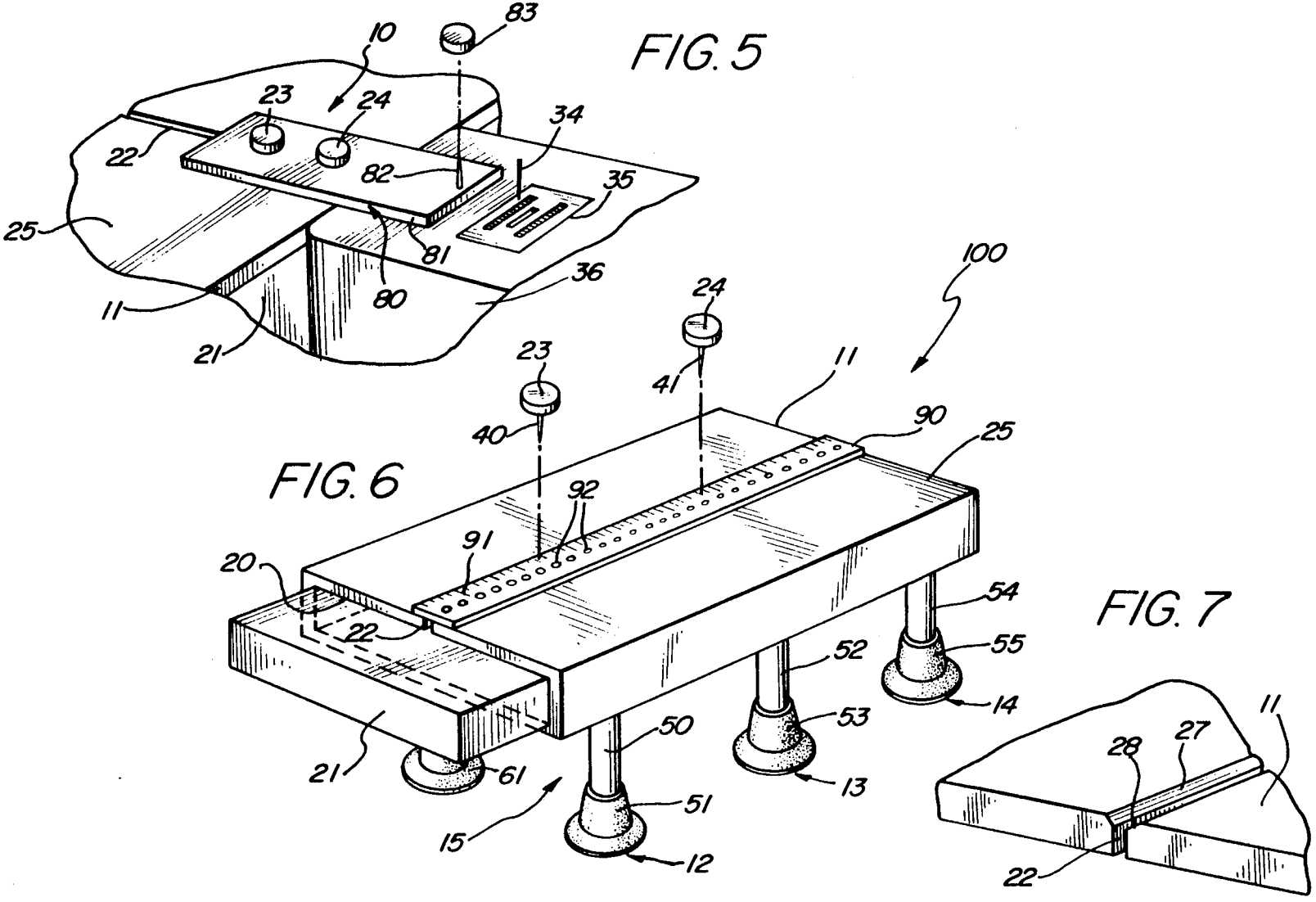
FIG. 5 sets forth a perspective view of an alternate embodiment of the present invention sewing machine accessory.
FIG. 6 sets forth a perspective view of a still further alternate embodiment of the present invention sewing machine accessory.
FIG. 7 sets forth a partially sectioned of a still further alternate embodiment of the present invention sewing machine accessory.

FIG. 5 sets forth an alternate embodiment of the present invention for use in sewing substantially smaller circles than can be accommodated by the embodiment shown in FIGS. 1 through 4. Thus, with accessory 10 positioned in abutment with material bed 36 of sewing machine 30 in the manner described above, work surface 25 is positioned with respect to the path of reciprocating needle 34 and throat plate 35 of sewing machine 30 such that slot 22 is centered in the path of needle 34 and extends outwardly therefrom. As described above, table 11 of accessory 10 includes a planar work surface 25 which is positioned in general alignment with the upper surface of material bed 26. An adapter 80 includes a generally planar plate 81 defining a pair of apertures (not shown) which receive material tacks 23 and 24 such that pointed elements 40 and 41 thereof (seen in FIG. 2) are received through such apertures and extend into slot 22 to be piercingly engaged with support plate 21. A pointed member 82 is positioned at the end of plate 81 and extends upwardly along the center portion thereof. A resilient cap 83, formed preferably of a fibrous type material or other structure adapted to receive pointed member 82 and attached thereto, is received upon pointed member 82 to captivate the to-be-sewn material in a pivotal attatchment similar to that described above.

In operation, with adapater 80 secured by material tacks 23 and 24 in the manner shown, the distance between pointed member 82 and the path of needle 34 may be adjusted by locating plate 81 and thereafter applying material tacks 23 and 24. With the desired position obtained, the radius of the arc sewn by needle 34 will be determined by the distance between pointed member 82 and the path of needle 34. Thus, the to-be-sewn material (not shown) is placed upon and pierced by pointed member 82 and underlies needle 34. Thereafter, cap 83 is placed upon pointed member 82 to captivate the underlying to-be-sewn fabric or material. The remainder of the stitching operation is carried forward in the manner described above. As can be seen, the position of pointed member 82 may be adjusted by moving plate 81 to provide very small radius circle stitches.

FIG. 6 sets forth a perspective view of an alternate embodiment of a sewing machine accessory constructed in accordance with the present invention and generally referenced by numeral 100. As described above, sewing accessory 100 includes an elongated generally rectangular work table 11 defining a planar work surface 25 and a center slot 22 extending the length of work surface 25. Table 11 further defines a generally rectangular interior passage 20 extending through work table 11 and receiving a rectangular support plate 21. Support plate 21 is preferably formed of a fibrous material which readily receives a piercing element in a removable fixed attachment. Accessory 100 further includes an elongated rule 90 defining a plurality of equally spaced apertures 92 aligned with slot 22. Rule 90 further defines a plurality of measuring graduations 91 arranged along either side of slot 22. A plurality of support legs such as support legs 50, 52 and 54 are secured to the underside of work table 11 and extend generally downwardly therefrom. In the preferred embodiment, support legs 50 through 54 terminate in a downwardly facing suction cup plurality 51, 53 and 55 respectively. Similarly, a second plurality of support legs 60, 62 and 64 (seen in FIG. 4) include a corresponding plurality of downwardly facing suction cup supports 61, 63 and 65 respectively (also seen in FIG. 4). A pair of material tacks 23 and 24 define generally disk-shaped members preferably formed of a molded plastic material or the like defining respective downwardly extending pointed members 40 and 41. In accordance with the above-described operation of the present invention, material tacks 23 and 24 are insertable into slot 22 through the appropriate one of apertures 92 at the desired place along work surface 25. As a result of this insertion and the piercing of support plate 21 as accessory 10 is used on successive material operations, a plurality of pierced holes such as holes 45 are formed in support plate 21. As pierced holes 45 accumulate, deterioration of support plate 21 occurs and, in accordance with an important aspect of the present invention, support plate 21 may be reverse from the position shown in FIG. 2 and reinserted into passage 20 to provide additional piercing surfaces for pointed elements 40 and 41. Once both sides of support plate 21 have been pierced beyond the desired number of piercings, in further accordance with the present invention, support plate 21 may be withdrawn entirely and disposed of and replaced by a replacement support plate (not shown).

FIG. 7 sets forth a partial section view of an alternate embodiment of the present invention sewing machine accessory. In accordance with the structure set forth above, table 11 includes an elongated slot 22. The embodiment of FIG. 7 differs from the embodiments shown in FIGS. 1 through 6 in that a pair of angled surfaces 27 and 28 are formed along the upper edges of slot 22 and extend the length of table 11. The function of angle surfaces 27 and 28 is to facilitate the location of the pointed elements of material tacks 23 and 24. In all other respects, the embodiment of FIG. 7 functions in accordance with the above-described operation of either of the embodiments shown in FIGS. 1 through 6.

What has been shown is a convenient, low cost and easy to use sewing machine accessory which provides a precise method for sewing circular or arced stitches. The device shown may be fabricated without excessive costs and provides great flexibility in the radius of curvature to be obtained. In addition, the present invention accessory is capable of use with virtually any standard sewing machine without modification to the sewing machine or its associated components.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. For use in combination with a sewing machine having a workbed surface for supporting material during the sewing process, an accessory for sewing arc shaped stitch paths comprising:

a generally planar table defining an interior passage and having a work surface defining an elongated slot therein;

support means for supporting said table with said work surface in general alignment with said workbed surface;

a material tack having a head portion and a pointed member; and a support plate formed of a pierceable material and received and supported within said interior passage, said support plate having a characteristic for permitting said pointed member to be held by said pierceable material when it pierces said support plate, said table being aligned with said workbed of said sewing machine and receiving to-be-stitched material, said material rotatably attached to said table by said material tack piercing said material.

2. An accessory as set forth in claim 1 wherein said table includes a plurality of graduations adjacent said slot.

3. An accessory as set forth in claim 2 wherein said table and said interior passage define generally rectangular cross sections.

4. An accessory as set forth in claim 3 wherein said support means include a plurality of support legs.

5. An accessory as set forth in claim 4 wherein said table defines an undersurface opposite from said work surface and wherein said support legs each include first ends joined to said undersurface and second ends.

6. An accessory as set forth in claim 5 wherein said second ends each further include a suction-cup attachment.

7. An accessory as set forth in claim 6 wherein said support plate is formed of a fibrous material.

8. An accessory as set forth in claim 1 further including an extension plate having a generally elongated planar shape defining a first end securable to said work surface and a second end having an upwardly extending pointed member.

9. An accessory as set forth in claim 8 wherein said extension plate is securable to said work surface by a pair of material tacks each having a head portion and a pointed member.

10. An accessory as set forth in claim 9 further including a cap receivable upon said upwardly extended pointed member.

11. An accessory as set forth in claim 1 further including an elongated rule member having a plurality of equally spaced apertures, said rule member receivable upon said work surface and secured thereto by a pair of said material tacks.

* * * * *